United States Patent [19]

Knapp et al.

[11] Patent Number: 4,893,053

[45] Date of Patent: Jan. 9, 1990

[54] COLOR DISPLAY TUBE WITH CHANNEL ELECTRON MULTIPLIER MEANS

[75] Inventors: Alan G. Knapp, Crawley; John R. Mansell, East Grinstead, both of United Kingdom

[73] Assignee: U.S. Philips Corporation, New York, N.Y.

[21] Appl. No.: 922,790

[22] Filed: Oct. 23, 1986

Related U.S. Application Data

[63] Continuation of Ser. No. 625,398, Jun. 28, 1984, abandoned.

[30] Foreign Application Priority Data

Jul. 8, 1983 [GB] United Kingdom ..... 8318493

[51] Int. Cl.[4] ..... H01J 29/80; H01J 29/46

[52] U.S. Cl. ..... 313/400; 313/105 CM

[58] Field of Search ..... 313/103 CM, 105 CM, 313/400

[56] References Cited

U.S. PATENT DOCUMENTS

| | | | |
|---|---|---|---|
| 4,023,063 | 5/1977 | King et al. | 313/400 |
| 4,034,254 | 7/1977 | King et al. | 313/400 |
| 4,511,822 | 4/1985 | Washington et al. | 313/400 |

FOREIGN PATENT DOCUMENTS 1458909 12/1976 United Kingdom .

*Primary Examiner*—Palmer C. DeMeo

*Attorney, Agent, or Firm*—Robert J. Kraus

[57] ABSTRACT

A color display tube which has a channel plate electron multiplier for multiplying a low voltage, low current electron beam and thereby obtaining an amplified output beam for producing an image on a screen formed of a plurality of different phosphors arranged as dots, each of which is surrounded by at least one ring. In order to form the output beam into well defined dots and rings to obtain good color purity, the source-to-screen distance of the output beam is varied in a predetermined manner. A means for doing this comprises additional electrodes mounted on the output side of the electron multiplier.

8 Claims, 2 Drawing Sheets

COLOR DISPLAY TUBE WITH CHANNEL ELECTRON MULTIPLIER MEANS

This is a continuation of application Ser. No. 625,398, filed June 28, 1984, and now abandoned.

BACKGROUND OF THE INVENTION

The present invention relates to a colour display tube which can be used for image display as well as datagraphic display.

More particularly the present invention relates to a display tube comprising a channel plate electron multiplier and a cathodoluminescent screen formed by dots of one phosphor surrounded by one or two rings of other phosphors. For convenience of description this screen will be referred to as a dot and ring display screen.

A display tube having such a display screen is disclosed in British Patent Specification 1446774 (corresponding to U.S. Pat. No. 4,023,063). In this known tube the electron multiplier comprises a plurality of apertured dynodes which are insulated from each other. The apertures have a re-entrant shape in that they have their minimum cross-sectional areas at the input and output surfaces of each dynode. An apertured focusing electrode is mounted on the output dynode and is insulated therefrom. The apertures in the focusing electrode diverge in the direction towards the dot and ring display screen. In operation a substantially constant potential difference, which provides an accelerating field, is maintained between the last dynode and the screen. A positive voltage Vf between the last dynode and the focusing electrode is variable and serves to draw out the electrons and shape them into a beam. By varying the voltage Vf the size and shape of the electron beam emerging from a channel can be changed. More specifically, a circular "solid" beam of a minimum diameter is formed when the voltage Vf is zero (OV). By making the voltage Vf more positive, the electron beam is formed into an annular (or ring like) cross section the diameter increasing to a maximum at a typical maximum voltage of 140V.

A modification of this known tube is disclosed in British Patent Specification 1452554 (corresponding to U.S. Pat. No. 4,034,254) which is a Patent of Addition to British Patent Specification 1446774. In Specification 1452554 two focusing electrodes are provided. The first one has divergent apertures, which are smaller than the apertures in the dynodes, and serve to shape the electron beam emerging from the channel plate electron multiplier proper. The second focusing electrode has re-entrant shaped apertures and has a variable focusing voltage applied to it.

Whilst both these known display tubes are able to produce colour displays there is still a desire to improve on the quality of the dots and rings in order to get better colour purity.

SUMMARY OF THE INVENTION

According to the present invention there is provided a colour display tube comprising, within an envelope having a faceplate, means for producing an electron beam, a channel plate electron multiplier having an input side and an output side, means for scanning the electron beam across the input side of the electron multiplier, a dot and ring cathodoluminescent display screen arranged substantially parallel to, but spaced from, the output side of the channel plate electron multiplier and means for varying in a predetermined manner the distance between a source of the electron beam incident on the display screen, and the display screen and thereby varying the shape and size of the electron beam impinging on the screen.

The present invention is based on the recognition of the fact that the requirements for producing the best dots are different from those for producing the best rings. The source-to-screen distance in producing well defined dots and rings appears to be of importance. In the known tubes, the source-to-screen distance is the same for the electrons producing the dots and rings and hence they cannot produce well defined dots and rings.

The distance varying means may comprise means to vary the field at the output side of the electron multiplier. In the case of the electron multiplier comprising a stack of apertured dynodes, the aperture in each of the dynodes apart from the input dynode being of re-entrant shape, the field varying means may comprise additional apertured electrodes arranged parallel to, but spaced from, the dynode.

In an embodiment of the present invention the additional apertured electrodes comprise a first electrode adjacent to, but spaced from, the last dynode, the first electrode having a thickness less than that of the last dynode and apertures which diverge in a direction towards the screen, and a second electrode arranged adjacent to, but spaced from, the first electrode, the second electrode having a thickness less than that of the last dynode and apertures which converge in a direction towards the screen. If desired a third electrode may be arranged adjacent to, but spaced from, the second electrode, the apertures in the third electrode diverging in a direction towards the screen. The third electrode may be thicker than the first and second electrodes in which case the size of the apertures at the output surface of the third electrode is greater than the maximum size of the apertures in the first and second electrodes.

If the dynodes are made from half dynodes arranged back-to-back to provide the re-entrant apertures, then the first, second and third electrodes may be formed from half dynodes thereby ensuring compatability between them and the dynodes.

The surfaces of the convergent apertures in the second electrode may be secondary electron emitting surfaces and comprise the effective source of the electron beam for impinging on the phosphor rings(s). Thus the first and second electrodes together may be regarded as another dynode having re-entrant apertures provided that the correct voltages are applied to them.

If desired, the input faces of the first and third electrodes may be coated with a material having a low secondary emitting coefficient to reduce the unwanted generation of secondary electrons from these faces.

In order to reduce the risk of the occurrence of an extra unwanted ring, the distance between the first and second electrodes maybe increased relative to the distance between the last dynode and the first electrode.

BRIEF DESCRIPTION OF THE DRAWINGS

The present invention will now be described, by way of example, with reference to the accompanying drawings, wherein.

In the drawings the same reference numerals have been used to indicate the same parts.

DESCRIPTION OF THE PREFERRED EMBODIMENTS

Figure 1:
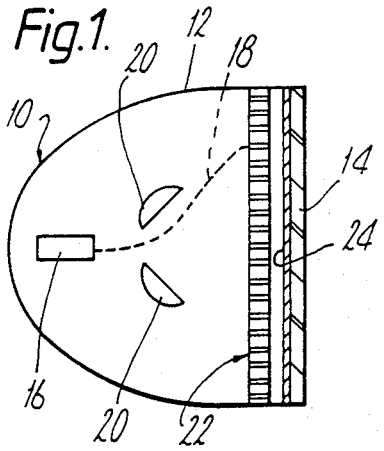
FIG. 1 is a diagrammatic cross section through a display tube made in accordance with the present invention.

The display tube 10 illustrated in FIG. 1 comprises a metal envelope 12 with a flat, glass, optically-transparent faceplate 14. A source 16 of a low current, low voltage electron beam 18 is provided within the envelope 12. The low current, low voltage electron beam 18 is scanned in a desired manner across an input side of a channel plate electron multiplier 22 by means of electromagnetic beam deflectors 20. The electron beam emerging from the electron multiplier 22 is accelerated towards a dot and ring cathodoluminescent screen 24 applied to the faceplate 14.

Figure 2:
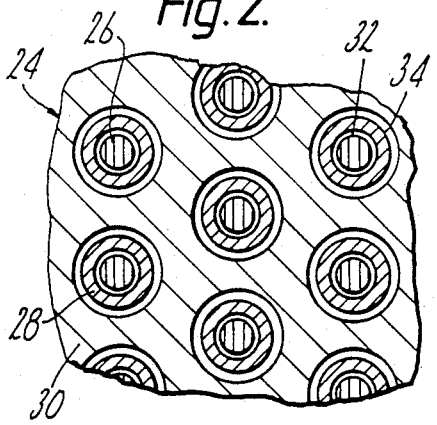
FIG. 2 is a diagrammatic view of a dot and ring display screen which can be used in the display tube shown in FIG. 1.

An example of a dot and ring screen 24 is shown in FIG. 2. In FIG. 2 the screen 24 comprises a dot 26 of a first colour phosphor, an outer concentric ring 28 of a second colour phosphor and a third colour phosphor in the area 30 external of the rings 28. Guard rings 32, 34 are provided between the dots 26 and the rings 28 and between the rings 28 and the area 30, respectively. If desired the guard rings 32, 34 may be filled with a black matrix material. Other arrangements of dot and ring screens maybe used, for example, the dot may comprise a penetration phosphor capable of luminescing in two primary colours and in such a case the ring or area surrounding the dot will comprise a phosphor capable of luminescing in the third primary colour, such a screen is disclosed in British Patent Specification No. 2129205A.

Figure 3:
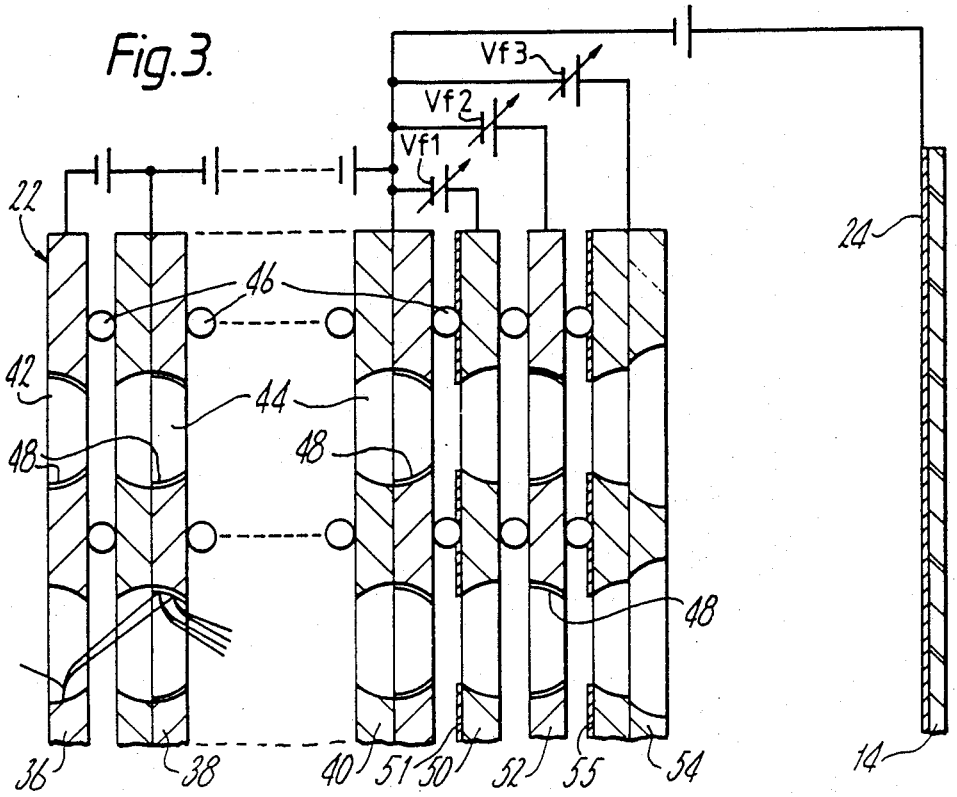
FIG. 3 is an enlarged cross-sectional view of part of a channel plate electron multiplier together with additional colour selection electrodes.

The electron multiplier 22 shown in FIG. 3 is a laminated plate electron multiplier and comprises a stack of dynodes, say 7 dynodes, of which the first two 36, 38 and the last one 40 have been shown. The construction of the electron multiplier 22 is disclosed in detail in the prior art of which British Patent Specifications 1434053 and 2023332A. are two examples. The second 38 and subsequent dynodes have twice the thickness of the first dynode 36. The dynodes may be made of a secondary emitting material, but in the case of large area ones then they will be made of mild steel which can be accurately etched more easily than some known secondary emitting materials. The apertures 42 in the first dynode 36 converge from the input surface thereof. However the second 38 and subsequent dynodes have re-entrant or barrel shaped apertures 44. As it is difficult to etch re-entranat apertures in a single sheet of material then conveniently the second 38 and subsequent dynodes are made by placing two half dynodes having convergent apertures back-to-back so that the surfaces into which the larger cross-sectional aperture opens abut. The first dynode 36 conveniently comprises a half dynode. Each dynode is spaced from its adjacent ones by insulating or resistive spacers 46. A potential difference of between 200 and 500V D.C. typically exists between successive dynodes, and a potential difference of the order of 8kV exists between the last dynode 40 and the screen 24.

In operation an electron incident in an aperture 42 of the first dynode 36 produces several secondary electrons which impinge on the further half dynode of the second dynode 38 and so on. As mild steel is not a good secondary emitter then a secondary emitting material 48, for example magnesium oxide, can be provided in apertures of the first dynode 36 and the further half dynode of the second 38 and subsequent dynodes. Three colour selection electrodes 50, 52 and 54, which are insulated and spaced from each other, are mounted on last dynode 40 of the electron multiplier 22. First and second colour selection electrodes 50, 52 comprise half dynodes and because the first electrode 50 has divergent apertures which are aligned with convergent, secondary emitting apertures in the second electrode 52, then taken together they may be regarded as being another dynode provided that the correct voltages are applied to the electrodes 50, 52. The third colour selection electrode 54 comprises two abutting half dynodes of which the second one has over-etched apertures, thus ensuring that an electron beam emerging from the electron multiplier 22 is not obstructed. Each electrode 50, 52 and 54 is held at a predetermined voltage relative to the last dynode 40. These voltages are referenced Vf1, Vf2 and Vf3 and by varying them in a predetermined manner then the source-to-screen distance of the electron beam emerging from the electron multiplier 22 can be varied to produce a well, defined dot or ring at the screen 24. An example of producing a dot and two rings will be described with reference to FIGS. 4A, 4B and 4C.

Figure 4A:
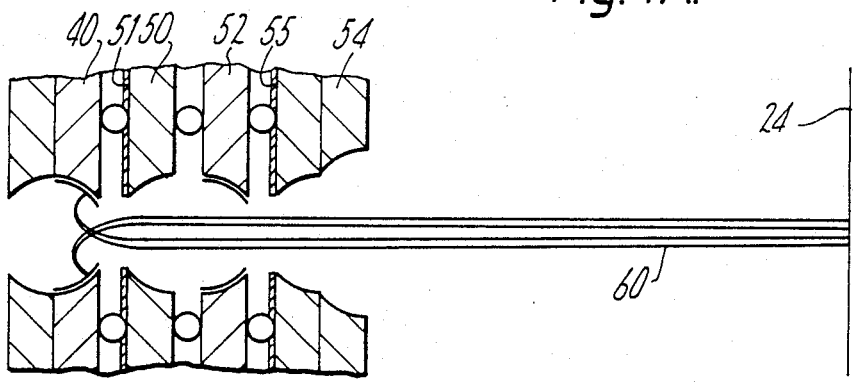
FIGS. 4A, 4B and 4C illustrate the operation of the additional colour selection electrodes whereby the source-to-screen distance is varied.

In the following example all the voltages are related to that of the last dynode 40 which is taken as being OV. The screen 24 is at +8kV. In order to shape the emergent electron beam to impinge on a dot 26 as shown in FIG. 4A, then Vf1=20V, Vf2=160V and Vf3=115V. The source for the emergent electron beam 60 comprises the last dynode 40 and the voltages on the electrodes 50, 52 and 54 serve to draw out the electron beam 60 from the last dynode and to focus the electron beam 60 at the screen 24.

Figure 4B:
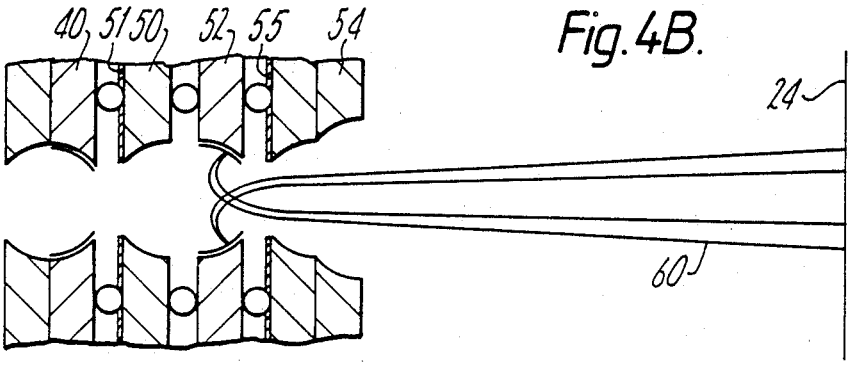

In the case of FIG. 4B, wherein the electron beam is shaped to impinge on a ring 28, Vf1=+350V, Vf2=+450V and Vf3=+520V. Under these conditions the source for the emergent electron beam 60 is the second electrode 52 which is closer to the screen 24 than the last dynode 40. Thus in consequence an additional stage of electron multiplication takes place. Also because the apertures in the electrode 54 are divergent then the electron beam 60 which has a ring-like or annular cross section diverges.

Figure 4C:
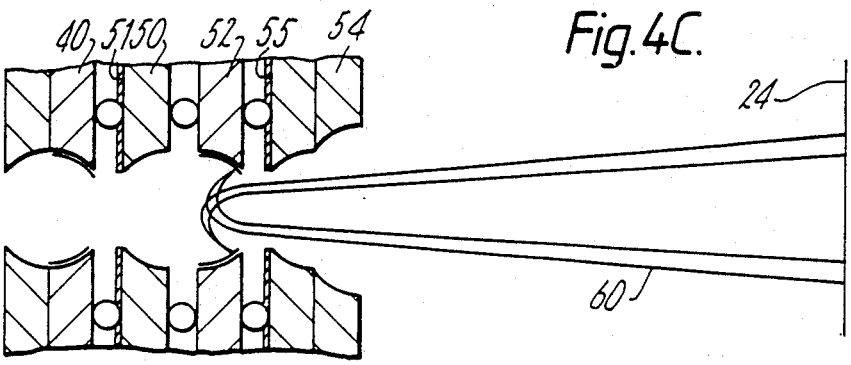

Finally in FIG. 4C, Vf1=+280V, Vf2=+400V and Vf3=+600V. The source of the emergent electron beam 60 remains at the second electrode 52 and the applied voltages enable the ring-like beam 60 to diverge further and to land on the area 30 outside the guard ring 34.

Thus by adjusting the voltages Vf1, Vf2 and Vf3 in say the line flyback period, the source-to-screen distance is varied and in so doing the size and cross-sectional shape of the emergent electron beam 60 are also varied thereby enabling a well defined dot or ring to be produced. The diameter of the rings depends upon the difference in voltage between the second and third electrodes 52, 54, respectively. Furthermore the thickness of the rings is dependant upon the mean potential of second and third electrodes 52, 54, respectively, that is (Vf2+Vf2)/2. The thickness decreases with increasing the mean potential and in the example given in FIGS. 4A to 4C falls to a minimum at about 500 volts.

The electrodes 50, 52 and 54 normally comprise half dynodes which are etched by standard etching techniques thereby enabling their cost to be comparable to that of the dynodes of the electron multiplier 22.

Optionally the input faces of the first and third electrodes 50, 54, respectively, may have a coating 51, 55, respectively, of a low secondary emitting material, for example carbon, to reduce the unwanted generation of secondary electrons from these faces.

If desired the distance between the first and second electrodes 50, 52, respectively, may be increased relative to the distance between the last dynode 40 and the first electrode 50 to prevent, in the ring generation mode, electrons from the last dynode 40 missing the secondary emitting surface in the second electrode and passing directly to the screen 24 and producing an extra, unwanted ring.

We claim:

1. A color display tube comprising an envelope including a faceplate, said envelope containing:

(a) means for producing an electron beam;

(b) electron multiplier means including a multiplicity of channels having respective input ends and output ends and containing secondary emissive material along the lengths thereof, said output ends being disposed opposite the faceplate at a predetermined distance therefrom;

(c) scanning means for scanning the electron beam across the input ends of the channels;

(d) a screen comprising a pattern of dots and surrounding rings of luminescent materials disposed on the faceplate for impingement by electrons from respective ones of the channels; and (e) output electrode means disposed between the electron multiplier means and the screen and having apertures aligned with corresponding ones of the output ends of said channels, said output electrode means in response to the application of predetermined voltages thereto controlling both the focusing of the electrons into beams and the distance from the center of each dot and ring to the source where the electrons focused into the corresponding electron beam last strike secondary emissive material, thereby controlling the shapes and widths of the electron beams where they impinge on the screen.

2. A color display tube comprising an envelope including a faceplate, said envelope containing:

(a) means for producing an electron beam;

(b) electron multiplier means including a multiplicity of channels having respective input ends and output ends and containing secondary emissive material along the lengths thereof, said output ends being disposed opposite the faceplate at a predetermined distance therefrom;

(c) scanning means for scanning the electron beam across the input ends of the channels;

(d) a screen comprising a pattern of dots and surrounding rings of luminescent materials disposed on the faceplate for impingement by electrons from respective ones of the channels; and (e) output electrode means disposed between the electron multiplier means and the screen and having apertures aligned with corresponding ones of the output ends of said channels, said output electrode means in response to the application of predetermined voltages thereto controlling both the focusing of the electrons into beams and the distance from the center of each dot and ring to the source where the electrons focused into the corresponding electron beam last strike secondary emissive material, thereby controlling the shapes and widths of the electron beams where they impinge on the screen;

said output electrode means comprising a plurality of electrodes including an electrode in which the apertures are defined by interior side walls containing secondary emissive material, said electrodes being arranged such that:

(a) upon application to the electrodes of first predetermined voltages, electrons from respective channels are directed toward the secondary emissive material in the apertures of said electrode, said apertures thereby functioning as electron multiplying devices and serving as the sources of the electron beams impinging on the screen; and (b) upon application to the electrodes of sound predetermined voltages, electrons from the respective channels are directed away from the secondary emissive material in the apertures of said electrode, thereby effecting operation of said channels as the sources of the electron beams impinging on the screen.

3. A color display tube as in claim 2 where the electron multiplier comprises a plurality of successively-arranged apertured dynodes, said output electrode means comprising:

(a) a first electrode adjacent to, but spaced from, a last one of the dynodes which includes the output ends of the channels, said first electrode having a thickness smaller than that of the last dynode and having apertures which diverge with increasing distance from the last dynode; and (b) a second electrode adjacent to, but spaced from, the first electrode, said second electrode having a thickness smaller than that of the last dynode and having apertures which converge with increasing distance from said last dynode.

4. A color display tube as in claim 3 where the output electrode means includes a third electrode adjacent to, but spaced from, the second electrode, said third electrode having apertures which diverge with increasing distance from said second electrode.

5. A color display tube as in claim 4 where the third electrode has a thickness which is larger than that of the first and second electrodes, the width of the apertures at an output surface of said third electrode being larger than the maximum width of the apertures in said first and second electrodes.

6. A color display tube as in claim 4 or 5 where the first and third electrodes have input faces which are coated with a material having a low secondary emission coefficient.

7. A color display tube as in claim 4 or 5 where the spacing between the first and second electrodes is larger than the spacing between the last dynode and said first electrode.

8. A color display tube as in claim 4 or 5 where sidewalls defining the apertures in the second electrode contain the secondary emissive material in the output electrode means.

* * * * *